US006401969B1

(12) United States Patent
Yajima et al.

(10) Patent No.: US 6,401,969 B1
(45) Date of Patent: Jun. 11, 2002

(54) APPARATUSES FOR SELECTING PRODUCT IN VENDING MACHINE

(75) Inventors: Hidekazu Yajima; Toshiyuki Takahashi; Toshio Itaya, all of Saitama-Ken (JP)

(73) Assignee: Sanyo Electric Co., Ltd., Osaka-Fu (JP)

( * ) Notice: Subject to any disclaimer, the term of this patent is extended or adjusted under 35 U.S.C. 154(b) by 12 days.

(21) Appl. No.: 09/688,929

(22) Filed: Oct. 17, 2000

(51) Int. Cl.[7] ..... G07F 11/00
(52) U.S. Cl. ..... 221/2; 340/825.35
(58) Field of Search ..... 221/2, 3, 7, 9, 221/13; 340/825.35, 286.01; 345/173, 156; 700/232, 231, 244

(56) References Cited

U.S. PATENT DOCUMENTS

| | | | | |
|---|---|---|---|---|
| 3,868,638 A | * | 2/1975 | Johnson | 359/143 |
| 4,236,649 A | | 12/1980 | Fellner et al. | |
| 4,311,227 A | | 1/1982 | Watkins | |
| 4,638,312 A | * | 1/1987 | Quinn et al. | 340/825.35 |
| 4,821,925 A | | 4/1989 | Wiley et al. | |

FOREIGN PATENT DOCUMENTS

| | | |
|---|---|---|
| EP | 0547020 | 6/1993 |
| WO | WO 98/45819 | 10/1998 |

* cited by examiner

*Primary Examiner*—Kenneth W. Noland
(74) *Attorney, Agent, or Firm*—McDermott, Will & Emery

(57) ABSTRACT

An apparatus for selecting a product in a vending machine by inputting a contemplated product number selected from product numbers assigned to respective types of products, comprises: a ten key for inputting a product number; a correction button which is operated in the course of or after the operation of the ten key to permit the product number to be re-input; an OK button which is operated after the completion of the operation of the ten key to establish the selection of the product; LED which can light up the ten key, the correction button, and the OK button separately from one another; and a control circuit for controlling LED in such a manner that the ten key, the correction button, and the OK button are successively lighted up according to the operating procedure. By virtue of this constitution, according to the apparatus for selecting a product in a vending machine, for example, when a purchaser buys a product in a vending machine by inputting a product number, advantageously, the purchaser can easily, quickly and clearly understand the operation for buying the product and consequently can smoothly and quickly buy the contemplated product.

13 Claims, 6 Drawing Sheets

APPARATUSES FOR SELECTING PRODUCT IN VENDING MACHINE

FIELD OF THE INVENTION

The invention relates to apparatuses for selecting a product in a vending machine, such as a vending machine which sells a plurality of types of products, by inputting a contemplated product number selected from product numbers assigned to respective types of products, for example, through the operation of buttons such as in a ten key.

BACKGROUND OF THE INVENTION

In recent years, various: vending machines, for example, vending machines, which can sell a plurality of types of products, and the so-called "see-through-type vending machines," which can see, from the front of the vending machine, products housed in the vending machine through a transparent front panel and utilize the products per se as a display, have been developed. In these vending machines, the provision of a selection button, operated by the purchaser to select a contemplated product, in each product results in the increased necessary number of buttons and wirings, and this increases the cost. Further, when the selection buttons are disposed respectively at positions corresponding to the products in the front panel, it becomes difficult to see the products, leading to deteriorated display effect. For this reason, a method has been adopted wherein a product number is assigned to each product and, in addition, a plurality of buttons for inputting a product number, together with a cash inlet port or the like, are collectively provided side by side in one place, for example, at the right end or left end in the front of the vending machine. An example of a group of buttons having a plurality of buttons for selecting a product through the input of a contemplated product number (hereinafter referred to as "input buttons") is the so-called "ten key" composed of 10 input buttons respectively on which numbers of 0 to 9 are written. The apparatus for selecting a product comprises, in addition to the ten key, for example, a display unit for displaying the input product number, a correction button for correcting an input erroneous number, and an OK button operated by a purchaser to finally establish the selection (purchase) of the product after the input of the product number.

The vending machine provided with the above product selection apparatus sells a product through the following operation by a purchaser. Specifically, after the purchaser first puts a cash into a cash inlet port, the product number of a contemplated product is input through a ten key. In this case, the input product number. is displayed on a display unit. When the number displayed on the display unit is different from the product number of the contemplated product, for example, due to the depression of an erroneous number by the purchaser, the depression of a correction button by the purchaser permits the contemplated product number to be re-input through the ten key. After the product number is correctly input, the purchaser confirms that the input product number is consistent with the contemplated product number. Thereafter, an OK button is depressed to establish the selection of the product, and the product is delivered to a product output port.

This type of product selection apparatus is not a little difficult to handle for a person who handles the apparatus for the first time (hereinafter referred to as "beginner." Specifically, in most of the currently widely spread vending machines, selection buttons for selecting products corresponding to the product displays are disposed respectively at front positions corresponding to the product displays. In this case, what is required for the purchaser to buy the product is only to depress the. selection button once. On the other hand, in the case of the above product selection apparatus, when there was an erroneous operation in the depression of the ten key, the OK button, or the product number, the correction button should be depressed. Thus, when a person buys a product, he (she) should:depress a plurality of buttons. Therefore, handling this type of vending machine is not easy particularly for beginners unfamiliar with the operation.

For this reason, in vending machines provided with the above type of product selection apparatus, for example, the following three measures are taken so that the operation of buttons can be easily made even by beginners. The first measure is such that the operating procedure from the step of putting a cash to the step of depressing the OK button is described at a noticeable place around the ten key or the like, so that the purchaser can learn the operating procedure upon reading the description. The second measure is such that the steps of the operating procedure are itemized, and, in addition, lamps are provided respectively, in areas of the beginning of the items, thereby informing the purchaser of the button to be depressed while turning on the corresponding lamp. The third measure is to successively inform the purchaser of the steps of the operating procedure by a voice given from a voice output device built in the vending machine.

For the first and second measures, the operating procedure is written, or otherwise the steps of the operating procedure are itemized. In this case, the beginners cannot learn the operating procedure unless they read. This imposes a great burden on the purchaser and, in addition, inhibits quick purchase of the product. On the other hand, for the third measure, the operating procedure is informed by a voice. In this case, the voice is always given regardless of the purchaser or the purchase time, that is, even to purchasers familiar with the operating procedure and all day and all night. This is very noisy, and offers uncomfort to the purchaser or persons present around the vending machine.

An example of equipment, which is widely spread and utilized through the operation of a ten key, is a push-button phone. In the push-button phone, what is required for making a phone call is only to pick up the receiver followed by the operation of the ten key. Therefore, some purchasers would think that they can buy a contemplated product in a vending machine by operating the product selection apparatus in substantially the same manner as in the push-button phone. That is, they would think that simply putting a cash into the cash inlet port followed by the input of a contemplated product number through the operation of the ten key could deliver the product to the product output port. This causes the purchaser to sometimes forget to depress the OK button. Therefore, the purchaser cannot receive the product until the purchaser notices the necessity of depressing the OK button and depresses it. Thus, a considerable time is often taken for the purchase of the product.

SUMMARY OF THE INVENTION

The invention has been made with a view to solving the above problems of the prior art, and it is an object of the invention to provide an apparatus for selecting a product in a vending machine which, when a purchaser buys a product in a vending machine by inputting a product number, the purchaser can easily, quickly and clearly understand the operation for buying the product and consequently can smoothly and quickly buy the contemplated product.

According to the first feature of the invention, there is provided an apparatus for selecting a product in a vending machine by inputting, through the operation of a plurality of input buttons, a product number composed of a plurality of characters assigned to each product, said apparatus comprising:

a group of product selection buttons, which have the plurality of input buttons respectively on which the plurality of characters are written one letter by one letter, for inputting the product number;

a correction button which is operated in the course of or after the operation of the group of product selection buttons to permit the product number to be re-input by the group of product selection buttons;

an OK button which is operated after the completion of the operation of the group of product selection buttons to establish the selection of a product;

lighting means which can light up the group of product selection buttons, the correction button, and the OK button separately from one another; and control means for controlling the lighting means in such a manner that the group of product selection buttons, the correction button, and the OK button are successively lighted up according to the operating procedure.

According to this construction, when a person buys a product in a vending machine provided with a product selection apparatus comprising the group of product selection buttons, the correction button, and the OK button, at the time of purchase, the group of product selection buttons, the correction button, and the OK button are successively lighted up by the lighting means controlled by the control means, according to the procedure to be operated by the purchaser (operating procedure).

More specifically, the purchaser operates the product selection apparatus and selects a product according to the following operating procedure.

① A product number is input by operating the group of product selection buttons.

② When the purchaser has noticed, in the course of or after the operation of the group of product selection buttons, that is, in the course of input of the product number or after the input of the product number, that there was an erroneous input, the purchaser depresses the correction button and then re-inputs the correct product number through the group of product selection buttons.

③ After the operation of the group of product selection buttons is ended, that is, after the product number is input, the purchaser confirms whether or not the input number is consistent with the product number of the contemplated product. In this case, when the input,number is consistent with the product number of the contemplated product, the OK button is depressed to establish the selection of the product.

In this case, in the steps ① to ③, the group of product selection buttons, the correction button, and the OK button are lighted up as described in ① to ③ below. In this connection, it should be noted that, before the operation of purchase, none of the group of product selection buttons, the correction button, and the OK button are lighted up.

① Only the group of product selection buttons are lighted up. This informs the purchaser of that a contemplated product number should be input :by operating the input buttons in the group of product selection buttons, and urges the purchaser to operate the group of product selection buttons.

② As soon as the input buttons in the group of product selection buttons are operated, or as soon as all the characters constituting the product number are input by this operation, the correction button is lighted up. This informs the purchaser of that the product number may be re-input, for example, when an erroneous product number was input.

③ As soon as the group of product selection buttons are operated to input all the characters constituting the product number, the OK button is lighted up. This informs the purchaser of that the selection of the product should be established by operating the OK button, and urges the purchaser to depress the OK button.

As described above, the group of product selection buttons, the correction button, and the OK button are successively lighted up according to the operating procedure of the product selection apparatus. Therefore, the buttons to be operated appeal to the visual sense of the purchaser, so that the purchaser can easily, quickly and clearly understand the operating procedure. Consequently, even beginners can perform smooth and quick operation, and can buy a contemplated product in a smooth and quick manner.

The production selection apparatus according to the first feature of the invention preferably further comprises: a cash inlet port into which a cash is put; and cash detection means for detecting whether or not a cash has been put into the cash inlet port, and the control means controls the lighting means in such a manner that, when the cash detection means has detected that the cash has been put into the cash inlet port, only the group of product selection buttons are lighted up.

According to this construction, as soon as the cash detection means detects that a cash has been put into the cash inlet port, only the group of product selection buttons are lighted up through an interlock with this operation. Therefore, after the cash is put into the cash inlet port, the purchaser can easily learn that the group of product selection buttons should be operated.

In this production selection apparatus according to the first feature of the invention, preferably, bright/dark detection means is further provided for detecting whether or not the brightness level of a place around the vending machine is lower than a predetermined brightness level, and the control means controls the lighting means in such a manner that, when the bright/dark detection means has detected that the brightness level of the place around the vending machine is lower than the predetermined brightness level, the group of product selection buttons are lighted up at a stage before the cash is put into the cash inlet port.

According to this construction, as soon as the bright/dark detection means detects that, for example, at dusk, the brightness level of a place around the vending machine is lower than the predetermined brightness level, the group of product selection buttons are lighted up even at a stage before the cash is put into the cash inlet port. By virtue of this, the group of product selection buttons are in a lighted up state even when the place around the vending machine is dark, for example, during night. Therefore, the production selection apparatus can draw attention and, in its turn, can enhance the level of an appeal of the vending machine per se. In this connection, wasteful power consumption can be prevented by constructing the production selection apparatus in. such a manner that the group of product selection buttons are not lighted up before the cash is put into the cash inlet port and, at the same time, when the brightness level of a place around the vending machine is higher than the predetermined brightness level, that is, for example, in;the daytime.

In the production selection apparatus according to the first feature of the invention, preferably, the control means controls the lighting means in such a manner that the correction button is lighted up upon the input of the first character in the product number by operating the group of product selection buttons.

According to this construction, upon the input of the first character in the product number, the correction button is lighted up. Therefore, the purchaser can easily understand that the correction is possible from a point in time immediately after one character in the product number is input.

In the production selection apparatus according to the first feature of the invention, preferably, the control means controls the lighting means in such a manner that the OK button is lighted up upon the input of all the characters constituting the product number by operating: the group of product selection buttons.

According to this construction, as soon as all the characters constituting the product number are input, the OK button is lighted up. This can inform the purchaser of that all the characters constituting the product number have been input, and, in addition, can urge the purchaser to operate the OK button.

In the production selection apparatus described just above, preferably, the control means controls the lighting means in such a manner that, upon the input of all the characters constituting the product number by operating the group of product selection buttons, the OK button is lighted up and, in addition, the light-up of the group of product selection buttons is released.

According to this construction, as soon as all the characters constituting the product number are input by the operation of the group of production selection buttons, the OK button is lighted up, and, at the same time, the light-up of the group of product selection buttons is released. This renders the OK button more noticeable than the group of product selection buttons. By virtue of this, the purchaser can more clearly understand that the OK button should be operated to establish the selection of the product. In this case, lighting up the correction button in addition to the OK button permits the correction button to be also noticeable. Therefore, the purchaser can easily understand that the OK button should be operated to establish the selection of the product and, in addition, the correction button can be operated to re-input the product number.

In the production selection apparatus according to the first feature of the invention, preferably, the control means controls the lighting means in such a manner that, when the group of product selection buttons, the correction button, or the OK button is lighted up, the selected button is intermittently lighted up.

According to this construction, the group of product selection buttons, the correction button, and the OK button are intermittently lighted up, that is, lighted up so as to be bunkered by the lighting means. Therefore, as compared with illumination of these buttons in a continuously lighted up state, the level of an appeal of the button to be operated to the purchaser can be enhanced.

According to the second feature of the invention, there is provided an apparatus for selecting a product in a vending machine by inputting, through the operation of a plurality of input buttons, a product number composed of a plurality of characters assigned to each product, said apparatus comprising:

a group of product selection buttons, which have the plurality of input buttons respectively on which the plurality of characters are written one letter by one letter, for inputting the product number;

a correction button which is operated in the course of or after the completion of the operation of the group of product selection buttons to permit the product number to be re-input by the group of product selection buttons;

an OK button which is operated after the completion of the operation of the group of product selection buttons to establish the selection of a product;

lighting means which can. light up the group of product selection buttons, the correction button, and the OK button separately from one another;

a cash inlet port into which a cash is put;

cash detection means for detecting whether or not a cash has been put into the cash inlet port; and control means for controlling the lighting means in such a manner that, when the cash detection means has detected that the cash has been put into the cash inlet port, the group of product selection buttons, the correction button, and the OK button are lighted up and, after the operation of the group of product selection buttons is ended, the OK button is intermittently lighted up.

According to this construction, as soon as the purchaser puts a cash into the cash inlet port and this is detected by the cash detection means, all of the group of product selection buttons, the correction button,; and the OK button are lighted up by lighting means controlled by the control means. This permits the buttons to be operated to appeal to the visual sense of the purchaser, so that the purchaser can easily, quickly and clearly understand that, after the cash is put into the cash inlet port, the group of product selection buttons and the like should be operated. As soon as the operation of the group of product selection buttons is ended, that is, as soon as the product number is input, the OK button is intermittently lighted up, that is, lighted up so as to be blinkered by the lighting means. Therefore, as compared with the group of product selection buttons and the correction button which are merely in a continuously lighted up state, this can appeal to the purchaser that the OK button should be operated. Therefore, it is possible to prevent the purchaser from forgetting to operate the OK button, and, thus, the purchaser can smoothly and quickly buy a contemplated product.

According to the third feature of the invention, there is provided an apparatus for selecting a product in a vending machine by inputting, through the operation of a plurality of input buttons, a product number composed of a plurality of characters assigned to each product, said apparatus comprising:

a group of product selection buttons, which have the plurality of input buttons respectively on which the plurality of characters are written one letter by one letter, for inputting the product number;

a correction button which is operated in the course of or after the completion of the operation of the group of product selection buttons to permit the product number to be re-input by the group of product selection buttons;

an OK button which is operated after the completion of the operation of the group of product selection buttons to establish the selection of a product;

lighting means which can light up the group of product selection buttons, the correction button, and the OK button separately from one another;

a cash inlet port into which a cash is put;

cash detection means for detecting whether or not a cash has been put into the cash inlet port; and control means for controlling the lighting means in such a manner that, when the cash detection means has detected that the cash has been put into the cash inlet port, the group of product selection buttons and the correction button are lighted up and, after the operation of the group of product selection buttons is ended, the OK button is intermittently lighted up.

According to this construction, as soon as the purchaser puts a cash into the cash inlet port and this is detected by the cash detection means, the group of product selection buttons and the correction button are lighted up by lighting means controlled by the control means. This permits the buttons to be operated to appeal to the visual sense of the purchaser, so that the purchaser can easily, quickly and clearly understand that, after the cash is put into the cash inlet port, the group of product selection buttons and the like should be operated. As soon as the operation of the group of product selection buttons is ended, the OK button is intermittently lighted up by the lighting means. Therefore, as compared with the group of product selection buttons and the correction button which are merely in a continuously lighted up state, this can appeal to the purchaser that the OK button should be operated. Therefore, it is possible to prevent the purchaser from forgetting to operate the OK button, and, thus, the purchaser can smoothly and quickly buy a contemplated product.

In any one of the product selection apparatuses according to the first to third features of the invention, preferably, display means is further provided for displaying the product number which has been input by operating the group of product selection buttons.

According to this construction, the input product number is displayed by the display means. Therefore, the purchaser can confirm whether or not the input being performed through the input buttons is correct and, in addition, whether or not the input number is correct, that is, whether or not the input number is consistent with ;the product number of the contemplated product, followed by the establishment of the selection of the product.

In any one of the product selection apparatuses according to the first to third features of the invention, preferably, each of the product numbers is composed of a character string of an identical number of characters.

According to this construction, since the number of characters in the character string constituting the product number assigned to each of the products is identical, the necessary number of times of the operation of the input buttons in the group of product selection buttons can be made identical. By virtue of this, independently of types of products purchased, the purchaser's operation of the input buttons by a given number of times suffices for the purchase of a contemplated product. This is convenient for purchasers who repeatedly utilize the vending machine. On the other hand, on the product selection apparatus side, whether or not all the characters constituting the product number have been input, that is, the completion of the operation of the group of product section buttons, can be easily judged, so that the timing of lighting up the OK button can be simply controlled.

In any one of the product selection apparatuses according to the first to third features of the invention, preferably, all of the input buttons in the group of product selection buttons, the correction button, and the OK button are projected outward, and the length of projection of the correction button and the length of projection of the OK button are smaller than the length of projection of the input buttons in the group of product selection buttons.

According to this construction, the length of outward projection of the correction button and the length of outward projection of the OK button are smaller than the length of outward projection of the input buttons in the group of product selection buttons. That is, the level of the correction button and the level of the OK button are lower by one step than the level of the group of product selection buttons. Therefore, the correction button and the OK button can be made more difficult to operate than the group of product selection buttons. This can reduce the probability of wrong operation of the correction button and the OK button at the time of the operation of the group of product selection buttons.

In any one of the product selection apparatuses according to the first to third features of the invention, preferably, the group of product selection buttons, the correction button, and the OK button are lighted up in different colors.

According to this construction, since the group of product selection buttons, the correction button, and the OK button are lighted up in different colors, the purchaser can clearly distinguish these buttons. In addition, the purchaser can more clearly learn which button should be operated.

BRIEF DESCRIPTION OF THE DRAWINGS

The invention will be explained in more detail in conjunction with the appended drawings, wherein:

FIGS. 2A to 2C are diagrams showing a button operation unit of a product selection apparatus, wherein FIG. 2A is a front view, FIG. 2B a right side view, and FIG. 2C a bottom view;

FIGS. 5A to 5D are diagrams showing an embodiment of the lighted up state of a button operation unit in a product selection apparatus, wherein FIG. 5A represents a state immediately after a cash is put into a cash inlet port, FIG. 5B a state immediately after the first digit number of the product number is input, and FIGS. 5C and 5D states immediately after the input of the product number is ended; and FIGS. 6A and 6B are diagrams showing another embodiment of the lighted up state of a button operation unit in a product selection apparatus, wherein FIG. 6A represents a state such that all the buttons are lighted up after a cash is put into a cash inlet port, and FIG. 5B a state such that all the buttons except for an OK button are lighted up after a cash is put into a cash inlet port.

DESCRIPTION OF THE PREFERRED EMBODIMENTS

Figure 1:
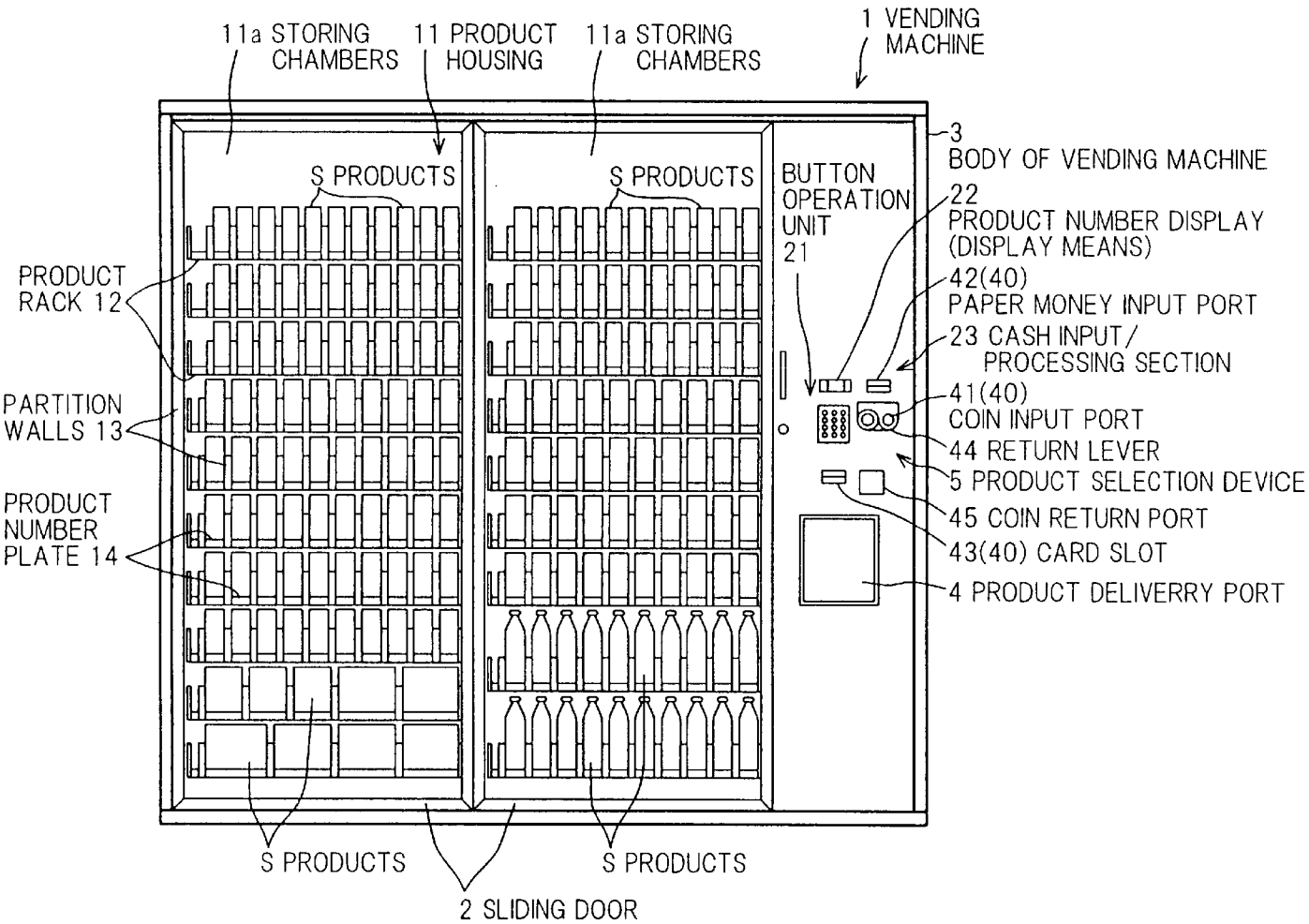
FIG. 1 is a front view of a vending machine provided with the product selection apparatus according to a preferred embodiment of the invention.

The preferred embodiments of the invention will be explained in more detail in conjunction with the accompanying drawings. FIG. 1 shows a vending machine provided with the product selection apparatus according to a preferred embodiment of the invention. As shown in the drawing, a vending machine 1 is a large-size vending machine which can sell a plurality of types of products S. This vending machine is of the so-called "see-through type" wherein these products S can be seen, from the front, through transparent sliding doors 2, 2 provided in the front of the vending machine and, at the same time, are utilized as displays. The vending machine 1 comprises: a vending machine body 3 in which products S are housed; a delivery mechanism (not shown) for delivering a product S selected by a purchaser to a product outlet port 4; a product selection apparatus 5 which, when a purchaser buys a product S, is operated by a purchaser to select a desired product S; and the like.

The vending machine body 3 is in a box form, and the two sliding doors 2, 2 are mounted on the opened front face of the box. Each sliding door 2 is always locked in a closed state. The sliding door 2 is opened, for example, when products S are replenished. The vending machine body 3 is replenished with the products S from the front of the vending machine. A product housing 11, which has an opened front face and is in a box form defined by an insulating peripheral wall, is disposed within the vending machine body 3. Two left and right storing chambers 11*a*, 11*a* are provided within the product housing 11. A horizontal product rack 12 of 10 stages in the vertical direction and a horizontal product rack 12 of 9 stages in the vertical direction are respectively disposed within the storing chambers 11*a*, 11*a*.

A plurality of partition walls 13 extended in the longitudinal direction are provided side by side in the lateral direction at proper intervals on each product rack 12. A product passage for storing products S of the same type arranged in the longitudinal direction is provided between the partition walls 13, 13. A pusher (not shown), which faces the product passage and is movable in the longitudinal direction, is provided at the right side portion of each of the partition walls 13. This pusher is moved forward at the time of selling to push all the products S. arranged in the longitudinal direction from behind, whereby a product S located in the forefront is delivered forward in the product passage.

A product number plate 14, on which a product number composed of a plurality of numbers is described, is provided at the front end face of the product rack 12 so as to correspond to each product passage, that is, so as to correspond to each product S. The product numbers are composed of numbers of which the number of digits is identical, for example, "11" or "101." In this preferred embodiment, since there are 100 or more types of products S which can be sold, the product numbers each are composed of a three-digit number.

The delivery mechanism (not shown) comprises: a bucket (not shown) which receives a product S, withdrawn from the product passage, at a position around the front of the product passage and stores the product S in the interior thereof; a drive mechanism (not shown) for driving the bucket in the vertical and lateral directions; and the like. By virtue of this delivery mechanism, at the time of selling, the bucket is moved to a position around the front of the product passage storing the selected product S, receives the withdrawn product S, and is moved to a position around the rear of the product outlet port 4. The selected product S is carried to the product outlet port 4, and is delivered to the purchaser.

The product selection apparatus 5 comprises: a button operation unit 21, having a plurality of buttons, which is disposed on the right side of the sliding doors 2,2; a product number display unit 22 (display means) for displaying, for example, a product number input by operating the button operation unit 21; a cash input/processing section 23 into which a cash is put and, in addition, which processes the cash; a bright/dark detector (bright/dark detection means) not shown, for detecting the brightness level of a place around the vending machine 1; a control circuit (control means) (not shown) comprising a microcomputer, for controlling the above units and sections; and the like.

Figure 2A:
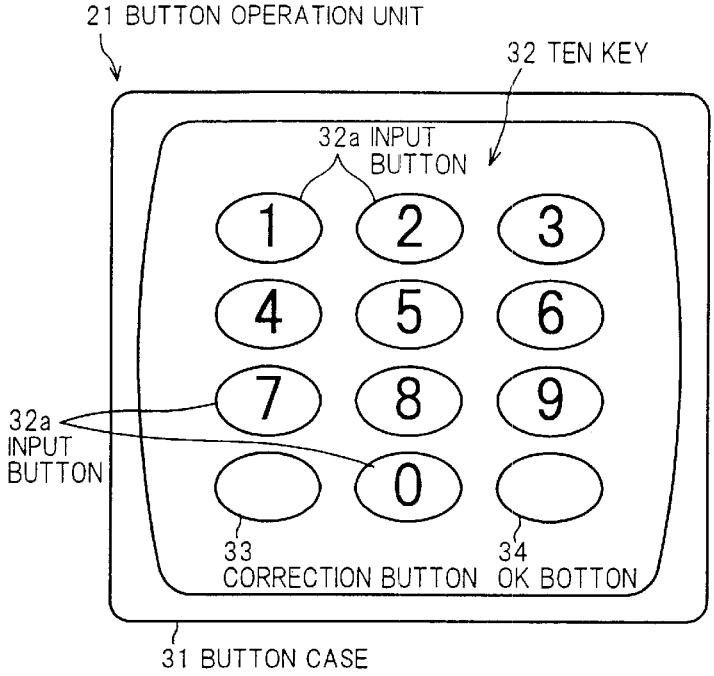

As shown in FIG. 2, the button operation unit 21 comprises: a button case 31 which is projected forward from the front of the vending machine body 3; a plurality of buttons which are disposed in the front of the button case 31, are elliptical, and are made of a transparent material; and a plurality of LEDs (lighting means) (not shown) which are disposed within the button case 31 and light up the buttons from behind them. Specifically, these plurality of buttons are constituted by 10 input buttons 32*a* respectively on which numbers of 0 to 9 are described, and comprise: the so-called ten key 32 for inputting a product number (a group of product selection buttons); a correction button 33 for correcting the input product number; and an OK button 34 for establishing the selection of the product S. Further, the plurality of LEDs are provided so as to correspond respectively to the ten key 32, the correction button 33, and the OK button 34 in such a manner that these buttons 32, 33, 34 can be lighted up separately from one another.

Figure 2B:
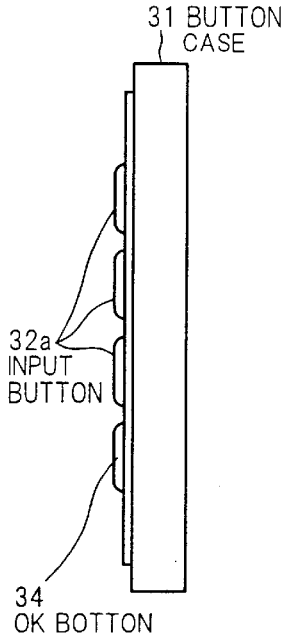
Figure 2C:
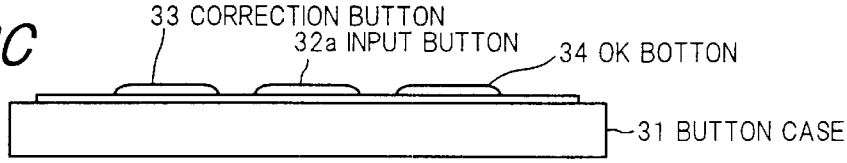

As described above, the ten key 32 is composed of a group of buttons operated for inputting a product number. A product number is input into the product selection apparatus 5 by properly depressing input buttons 32*a* in the group of buttons. As shown in FIGS. 2B and 2C, each input button 32*a* is projected outward (forward) from the surface of the button case 31, and, at the same time, the center portion is convexly formed in an outward direction. Further, each input button 32*a* is made of, for example, a green transparent material, and is lighted up so that each input button 32*a* per:se emits green light through LED for a ten key described later.

As described above, the correction button 33 is a button for correcting a product number input by operating the ten key 32. More specifically, the depression of the correction button during or after the completion of the operation of the ten key 32, that is, after the ten key 32 is operated to input the first digit or second digit number in the product number, or after all the numbers of 3 digits are input, permits the product number to be re-input by the ten key 32. As shown in FIG. 2C, the correction button 33 has a flat surface, and, in addition, the surface is projected outward (forward) from the surface of the button case 31 so that the length of projection is smaller than the length of projection of the input buttons 32*a* in the ten key 32. That is, the level of the correction button 33 is lowered by one step than the level of the input buttons 32*a*. This makes it more difficult to operate the correction button 33 than the operation of the ten key 32. As a result, the erroneous operation of the correction button 33 in the operation of the ten key 32 can be reduced. Further, the correction button 33 is formed of, for example, a yellow transparent material so as to be different from the color of the ten key 32, and is lighted up by LED for the correction button described later so that the correction button per se emits yellow light.

As described above, the OK button 34 is a button which is operated by the purchaser to finally establish the selection of the product S. More specifically, when the OK button 34 is depressed after the completion of the operation of the ten key 32, that is, after the input of all the numbers of 3 digits constituting the product number, the selection of the product S is established. Immediately after the operation of the OK button 34, the delivery mechanism (not shown) is operated to carry the selected product S to the product outlet port 4. Further, as shown in FIGS. 2B and 2C, the OK button 34 has a shape identical to the correction button 33, and is on a level lower by one step than the input buttons 32*a*. Therefore, in the OK button 34, as with the correction button 33, the occurrence of an error in the operation of the ten key 32 can be reduced. Further, the OK button 34 is formed of, for example, a blue transparent material which is different from the color of the ten key 32 and the correction button 33, and is lighted up by LED for the OK button as described later so that the OK button 34 per se emits blue light.

The plurality of LEDs not shown are constituted by three LEDs, i.e., LED for a ten key, LED for a correction button, and LED for an OK button (all not shown) which light up the ten key 32, the correction button 33, and the OK button 34, respectively. These LEDs are controlled by the control circuit (not shown) so as to successively light up the ten key 32, the correction button 33, and the OK button 34 according to the operating procedure. As soon as these LEDs are turned on, the ten key 32, the correction button 33, and the OK button 34 are lighted up so that they emit light of colors different from one another according to the color of the materials constituting them. By virtue of this, as compared with the case where the buttons are lighted up by an identical color, the purchaser can more clearly learn the button to be operated. Further, the same effect can be obtained by adopting a method wherein all the buttons 32, 33, 34 are formed of a colorless, transparent material and, at the same time, the LEDs, when turned on, emit light of different colors.

The LED for the ten key has 10 LEDs corresponding respectively to the input buttons 32*a*. On the other hand, LED for the correction button and LED for the OK button each are formed of a single LED. Alternatively, a construction may be adopted wherein all the 10 input buttons 32*a* are lighted up by a single or several LEDs as the LED for the ten key.

The product number display unit 22 has an illumination panel or a liquid crystal panel which faces the exterior. The numbers input by operating the ten key 32 are successively displayed on this panel. Alternatively, the product number display unit 22 may be constructed so that, for example, a message informing the purchaser of a button to be operated is displayed together with the input product number or while automatically switching from the input product number.

The cash input/processing section 23 comprises: a coin inlet port 41 for putting a coin thereinto and a paper money inlet port 42 for putting a paper money thereinto (cash inlet ports); a card slot 43 for inserting a prepaid card instead of a cash such as a coin (a cash inlet port); a return lever 44 for returning the cash or prepaid card put into the inlet port; a coin return port 45 which, upon the operation of the return lever 44, returns the coin to the purchaser; a cash detector (not shown) for detecting whether or not a cash or the like has been put into the coin inlet port 41 or the like (cash detection means); and the like. The cash detector is electrically connected to a control circuit (not shown), and, upon the detection of inlet of the cash or the like, outputs an electric signal to the control circuit. In this case, only the LED for the ten key is turned on by the control circuit, whereby the ten key 32 is lighted up.

The bright/dark detector not shown has a luminous energy detector (not shown) which faces the exterior and is electrically connected to the control circuit not shown. As soon as the bright/dark detector detects that the brightness level of a place around the vending machine 1 has been changed from a brighter state than a predetermined brightness level (hereinafter referred to as "bright state") to a darker state than the predetermined brightness level (hereinafter referred to as "dark state"), that is, as soon as the luminous energy detector detects that the luminous energy of a place around the vending machine 1 has been lowered to a level of less than the predetermined luminous energy, an electric signal indicating this change is output to the control circuit. In this case, only the LED for the ten key is turned on by the control circuit to light up the ten key 32. Further, as soon as the bright/dark detector detects that the brightness level of the place around the vending machine 1 has been changed from the dark state to the bright state, an electric signal indicating this change is output to the control circuit. In this case, the LED for the ten key in the lighted up state is turned off to release the illumination of the ten key 32.

Figure 3:
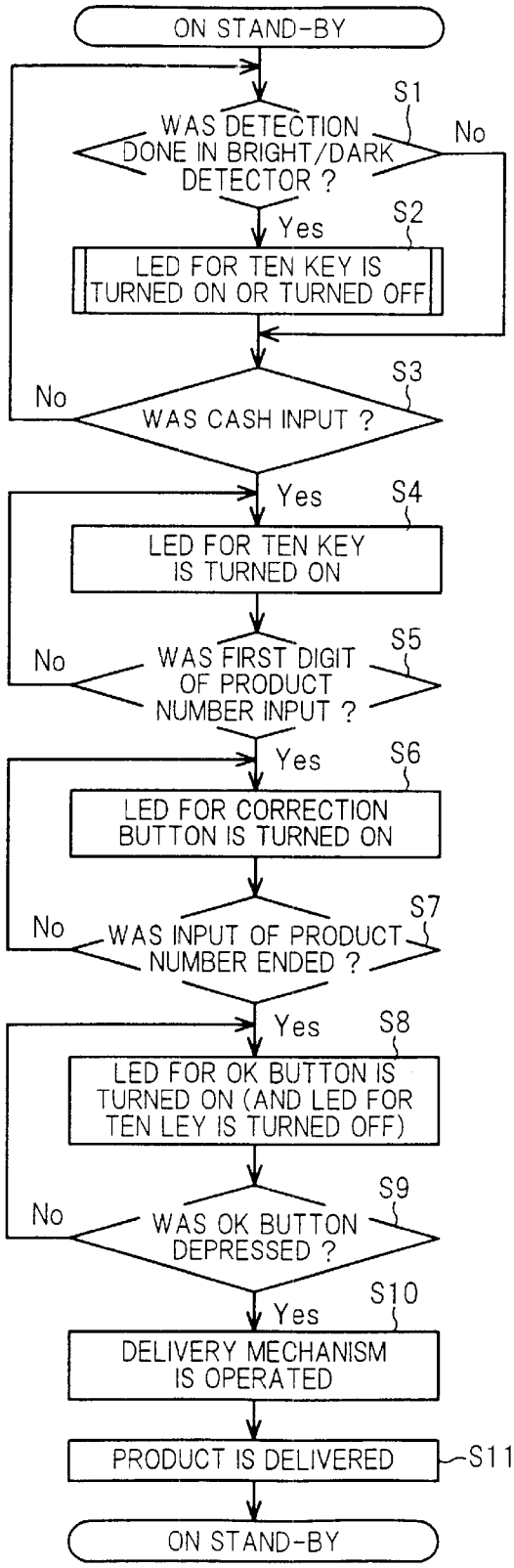
FIG. 3 is a flow chart showing the illumination of a button operation unit in a product selection apparatus.
Figure 4:
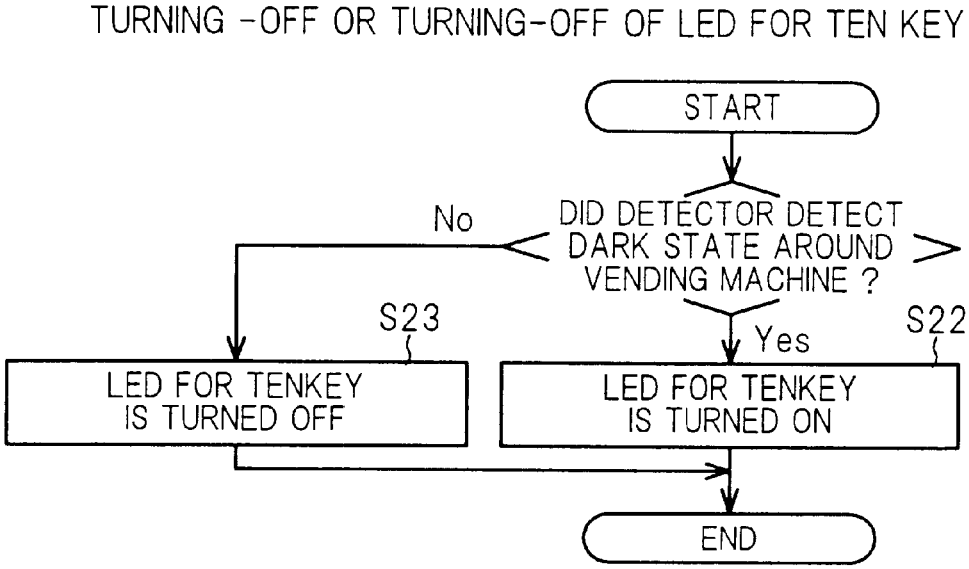
FIG. 4 is a flow chart showing the turning-on or turning-off of LED for a ten key.

Next, the operation of the product selection apparatus 5 at the time of selling, particularly the lighted up state of the button operation unit 21, together with the operating procedure of the product selection apparatus 5, will be described in more detail with reference to FIGS. 3 and 4 showing flow charts and FIG. 5 (a front view) showing the button operation unit 21.

When the vending machine 1 is in a stand-by state and, at the same time, the brightness level of a place around the vending machine 1 is in a bright state (hereinafter referred to as "stand-by state in daytime"), all of the LED for a ten key, the LED for a correction button, and the LED for an OK button are in a turn-off state. In this case, when a detection has been performed by the bright/dark detector not shown (S1: Yes), that is, when the brightness level of the place around the vending machine 1 has been changed from the bright state to the dark state or otherwise from the dark state to the bright state, the LED for the ten key is turned on or turned off (S2). As shown in FIG. 4, for example, at dusk, as soon as the bright/dark detector detects that the brightness level of a place around the vending machine 1 has become lower than the predetermined brightness level, that is, has been changed to the dark state (S21: Yes), the. LED for a ten key is turned on (S22), and only the ten key 32 is continuously lighted up (see FIG. 5A). By virtue of this, the ten key 32 is in the lighted up state even when the place around the vending machine 1 is dark, for example, during night. Therefore, the product selection apparatus 5 can draw attention and, in its turn, can enhance the level of an appeal of the vending machine 1 per se.

On the other hand, when the vending machine 1 in the stand-by state and, at the same time, a change of the place around the vending machine 1 from the dark state (hereinafter referred to as "stand-by state during night") to the bright state, for example, at dawn, has been detected (S21: No), the LED for a ten key, which has been in the lighted up state, is turned off (S23) to release the illumination of the ten key 32, followed by the continuation of the turn-off state. Thus, the LED for a ten key is turned off, for example, at dawn, and, when the place around the vending machine 1 is bright, for example, in the daytime, the LED for a ten key is in the turn-off state. Therefore, wasteful power consumption can be prevented.

When the vending machine 1 is in the stand-by state, as soon as the purchaser puts a cash into the cash inlet port, the product selection apparatus 5 performs the following operation. It should be noted that, in the following description, the coin inlet port 41, the paper money inlet port 42, and the card slot 43 are collectively called "cash inlet port 40" and the cash includes coins, paper moneys, and prepaid cards.

Figure 5A:
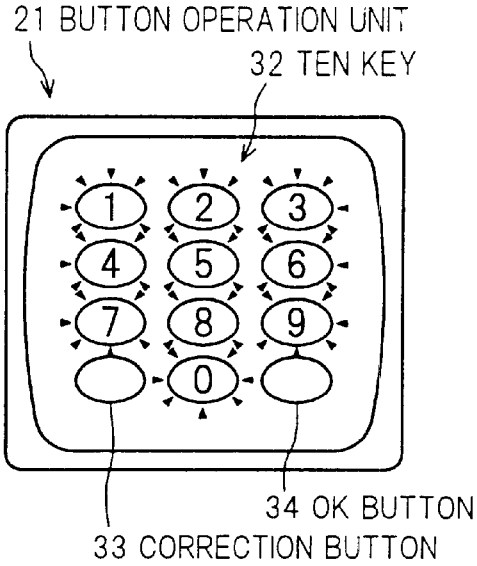

At the outset, when the vending machine 1 is the stand-by state in the daytime, a cash is put into the cash inlet port 40. As soon as this is detected by the cash detector not shown (S3: Yes), the LED for a ten key is turned on (S4), whereby only all the input buttons 32*a* for the ten key 32 are lighted up, as shown in FIG. 5A. This can inform the purchaser, who has put the cash into the cash inlet port, of that the ten key 32 should be operated to input a desired product number. When a cash has been put into the cash inlet port during the stand-by state of the vending machine 1 at night, there is no change in LED for a ten key because the LED for a ten key has already been lighted up in S22. Therefore, the turn-on state is continued.

Figure 5B:
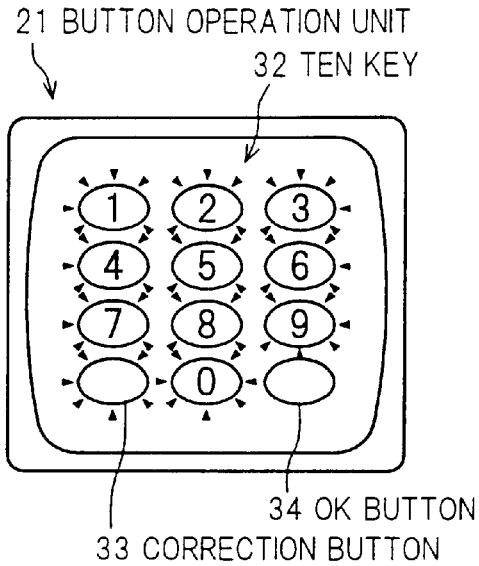

Next, upon the input of the first digit number in the product number of a product S which the purchaser wants to buy (S5: Yes), the LED for a correction button is turned on (S6), and, consequently, as shown in FIG. 5B, the correction button 33 is lighted up. This informs the purchaser, who has input the first digit number in the product number, of that, when the input number is erroneous, this number may be corrected. In this case, the input number is displayed on the product number display unit 22. By virtue of this, the purchaser can input the product number while confirming whether or not the contemplated product number is being correctly input.

Figure 5C:
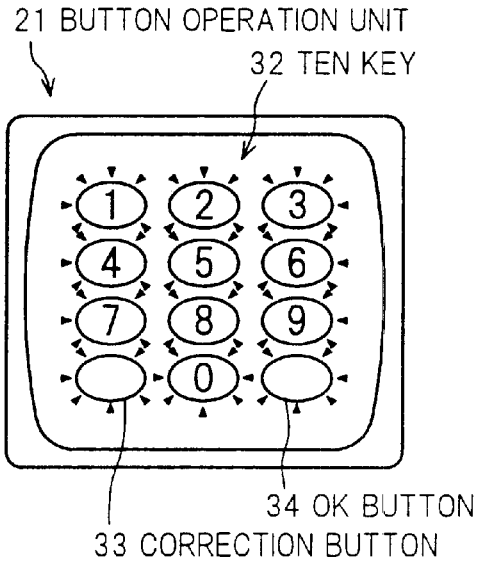

As soon as the input of the product number by the purchaser is completed, that is, as soon as all the numbers of three digits constituting the product number are input (S7: Yes), the LED for an OK button is turned on (S8), and, consequently, as shown in FIG. 5C, the OK button 34 is lighted up. This can inform the purchaser, who has completed the input of the product number, of that the OK button 34 should be operated to establish the selection of the product S, and, in addition, can urge the purchaser to operate the OK button 34.

Figure 5D:
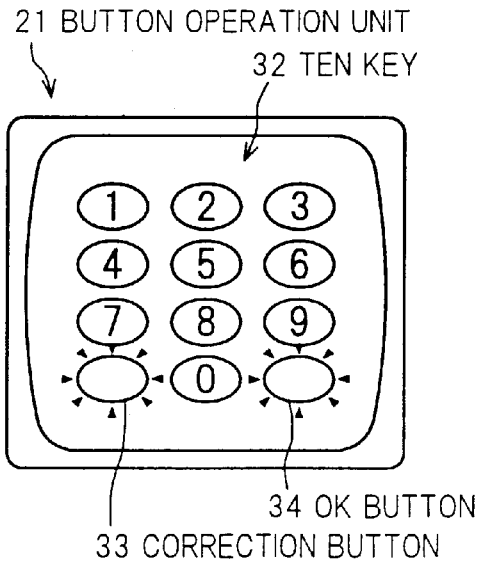

In this case, a method may be adopted wherein the LED for an OK button is turned on and, in addition, the LED for a ten key is turned off. As shown in FIG. 5D, this releases the illumination of the ten key 32, and, at the same time, only the correction button 33 and the OK button 34 are lighted up. This can clearly inform the purchaser, who has completed the input of the product number, of that the correction button 33 or the OK button 34 should be operated.

Thereafter, while viewing the display on the product number display unit 22, the purchaser can confirm whether or not the input product number is correct, that is, whether or not the input number is consistent with the product number of the desired product. When the input product number is correct, the OK button 34 is depressed to establish the selection of the product S. Upon the operation of the OK button 34 (S9: Yes), the delivery mechanism not shown is operated (S10), and the product S, to which the input product number is assigned, is carried to the product outlet port 4 (S11). This completes the selling of the product, and the vending machine 1 is returned to the stand-by state.

When the vending machine 1 is the stand-by state in the daytime, upon the completion of the selling, the LED for a ten key, the LED for a correction button, and the LED for an OK button, which have been in the turn-on state, are turned off to release the illumination of the ten key 32, the correction button 33, and the OK button 34. On the other hand, when the vending machine 1 is the stand-by state during night, only the LED for a correction button and the LED for an OK button are turned off, and only the ten key 32 is kept in the lighted up state.

As described above in detail, according to the product selection apparatus 5 of this preferred embodiment, the ten key 32, the correction button 33, and the OK button 34 are successively lighted up according to the operating procedure for the purchaser. Therefore, the button to be operated can appeal to the visual sense of the purchaser, and the purchaser can easily, quickly and clearly understand the operating procedure. Consequently, even beginners can perform the operation in a smooth and quick manner, and can smoothly and quickly buy the product S.

Further, for product numbers assigned to the products S, the number of digits is identical. Therefore, the number of times of operation of the input buttons 32*a* in the ten key 32 can be made identical. By virtue of this, regardless of types of products purchased, the purchaser's operation of the input buttons 32*a* by a given number of times always suffices for the purchase of a contemplated product. This is convenient for purchasers who repeatedly utilize the vending machine 1. On the other hand, on the product selection apparatus 5 side, whether or not all the characters constituting the product number have been input, that is, the completion of the operation of the ten key 32 can be easily judged, so that the timing of lighting up the OK button 34 by the LED for the OK button can be simply controlled.

It should be noted that the present invention is not limited to the above-described preferred embodiments and can be carried out according to various embodiments. More specifically, the present invention can be applied to see-through-type vending machines, as well as to other various vending machines. Further, in the preferred embodiments, in lighting up the ten key, the correction button, and the OK button, the LED for a ten key, the LED for a correction button, and the LED for an OK button have been merely turned on followed by the continuation of the lighted up state in these buttons. Alternatively, each of the LEDs may be blinkered so that the buttons each are intermittently lighted up. In this case, as compared with illumination of these buttons in a continuously lighted up state, the level of an appeal of the button to be operated to the purchaser can be enhanced.

Further, in the preferred embodiments, the ten key, the correction button, and the OK button each have been lighted up from the backside. The lighting-up method, however, is not limited to this only, and the buttons may be lighted up from the front. Further, instead of numbers 0 to 9, for example, alphabets, hiraganas (rounded Japanese phonetic syllabaries) and other various characters or symbols may be described on the input buttons so that they constitute product numbers.

Next, two other embodiments of the lighted up state (lighting-up procedure) in the button operation unit 21 different from the above embodiment will be briefly described with reference to FIG. 6.

Figure 6A:
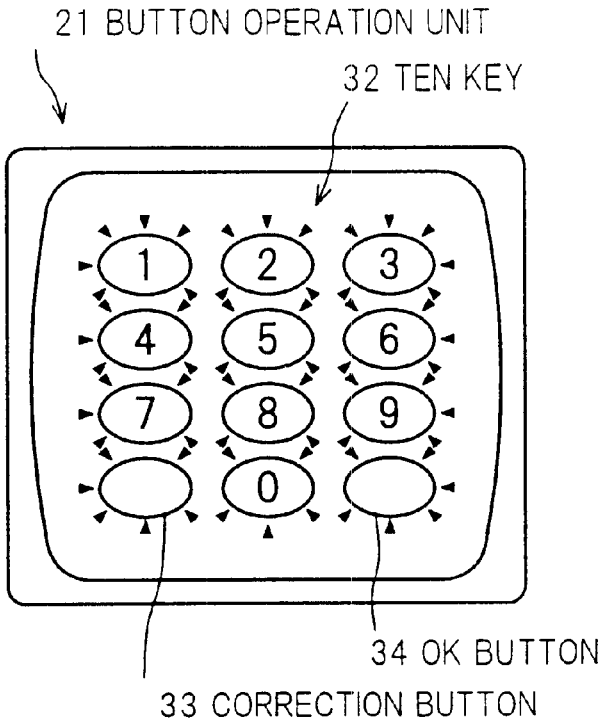
Figure 6A:
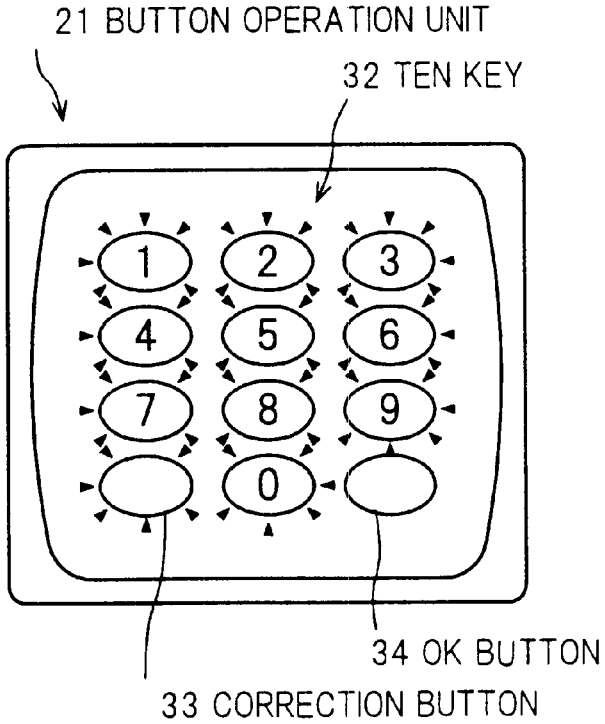

At the outset, according to the first other embodiment of the lighted up state, as soon as a cash is put into the cash inlet port 40 and this is detected by the cash detector not shown, as shown in FIG. 6A, all of the ten key 32, the correction button 33, and the OK button 34 are lighted up by turning on the LED for the ten key, the LED for the correction button, and the LED for the OK button. When the input of the product number by the purchaser has been completed, the LED for the ten key and the LED for the correction button remain turned on, while the LED for the OK button 34 is blinkered to intermittently light up the OK button 34. In this case, as compared with mere illumination of the ten key 32 and the correction button 33 in a continuously lighted up state, the level of an appeal of the OK button 34 to be operated to the purchaser can be enhanced. This can prevent the purchaser from forgetting to operate the OK button 34, and, thus, the purchaser can smoothly and quickly buy the product S.

The second other embodiment of the lighted up state will be described. As with the above embodiment, as soon as a cash is put into the cash inlet port 40, as shown in FIG. 6B, the ten key 32 and the correction button 33 are lighted up. Upon the completion of the input of a contemplated product number by the purchaser, as with the above embodiment, only the OK button 34 is intermittently lighted up. Therefore, also in this case, the OK button 34 to be operated can appeal to the purchaser, and the purchaser can smoothly and quickly buy the product S.

Moreover, in the embodiment of the lighted up state described above in detail and the two other embodiments of the lighted up state, a sound may be given by a buzzer or the like simultaneously with the illumination of the OK button 34. This can appeal to the sense of hearing of the purchaser in addition to the visual sense, whereby the purchaser can more clearly learn the necessity of operating the OK button 34.

It should be noted that the detailed construction and the like of the button operation unit, the product number display unit, the cash input/processing section, the bright/dark detector, and the control circuit described above in connection with the preferred embodiments; are merely an example, and may be suitably varied or modified within the scope of the present invention.

As is apparent from the foregoing detailed description, in the apparatus for selecting a product in a vending machine according to the present invention, for example, when a purchaser buys a product in a vending machine by inputting a product number, advantageously, the purchaser can easily, quickly and clearly understand the operation for buying the product and consequently can smoothly and quickly buy the contemplated product.

The invention has been described in detail with particular reference to preferred embodiments, but it will be understood that variations and modifications can be effected within the scope of the invention as set forth in the appended claims.

What is claimed is:

1. An apparatus for selecting a product in a vending machine by inputting, through the operation of a plurality of input buttons, a product number composed of a plurality of characters assigned to each product, said apparatus comprising:

a group of product selection buttons, which have the plurality of input buttons respectively on which the plurality of characters are written one letter by one letter, for inputting the product number;

a correction button which is operated in the course of or after the operation of the group of product selection buttons to permit the product number to be re-input by the group of product selection buttons;

an OK button which is operated after the completion of the operation of the group of product selection buttons to establish the selection of a product;

lighting means which can light up the group of product selection buttons, the correction button, and the OK button separately from one another; and control means for controlling the lighting means in such a manner that the group of product selection buttons, the correction button, and the OK button are successively lighted up according to the operating procedure.

2. The apparatus according to claim 1, which further comprises:

a cash inlet port into which a cash is put; and cash detection means for detecting whether or not a cash has been put into the cash inlet port, said control means controlling the lighting means in such a manner that, when the cash detection means has detected that the cash has been put into the cash inlet port, only the group of product selection buttons are lighted up.

3. The apparatus according to claim 2, which further comprises bright/dark detection means for detecting whether or not the brightness level of a place around the vending machine is lower than a predetermined brightness level, said control means controlling the lighting means in such a manner that, when the bright/dark detection means has detected that the brightness level of the place around the vending machine is lower than the predetermined brightness level, the group of product selection buttons are lighted up at a stage before the cash is put into the cash inlet port.

4. The apparatus according to claim 1, wherein said control means controls the lighting means in such a manner that the correction button is lighted up upon the input of the first character of the product number by operating the group of product selection buttons.

5. The apparatus according to claim 1, wherein said control means controls the lighting means in such a manner that the OK button is lighted up upon the input of all the characters of the product number by operating the group of product selection buttons.

6. The apparatus according to claim 5, wherein said control means controls the lighting means in such a manner that, upon the input of all the characters of the product number by operating the group of product selection buttons, the OK button is lighted up and, in addition, the light-up of the group of product selection buttons is released.

7. The apparatus according to claim 1, wherein said control means controls the lighting means in such a manner that, when the group of product selection buttons, the correction button, or the OK button is lighted up, the selected button is intermittently lighted up.

8. The apparatus according to claim 1, which further comprises display means for displaying the product number which has been input by operating the group of product selection buttons.

9. The apparatus according to claim 1, wherein the product number is composed of a character string of an identical number of characters.

10. The apparatus according to claim 1, wherein all of the input buttons in the group of product selection buttons, the correction button, and the OK button are projected outward, and the length of projection of the correction button and the length of projection of the OK button are smaller than the length of projection of the input buttons in the group of product selection buttons.

11. The apparatus according to claim 1, wherein the group of product selection buttons, the correction button, and the OK button are lighted up in different colors.

12. An apparatus for selecting a product in a vending machine by inputting, through the operation of a plurality of input buttons, a product number composed of a plurality of characters assigned to each product, said apparatus comprising:

a group of product selection buttons, which have the plurality of input buttons respectively on which the plurality of characters are written one letter by one letter, for inputting the product number;

a correction button which is operated in the course of or after the operation of the group of product selection buttons to permit the product number to be re-input by the group of product selection buttons;

an OK button which is operated after the completion of the operation of the group of product selection buttons to establish the selection of a product;

lighting means which can light up the group of product selection buttons, the correction button, and the OK button separately from one another;

a cash inlet port into which a cash is put;

cash detection means for detecting whether or not a cash has been put into the cash inlet port; and control means for controlling the lighting means in such a manner that, when the cash detection means has detected that the cash has been put into the cash inlet port, the group of product selection buttons, the correction button, and the OK button are lighted up and, after the operation of the group of product selection buttons is ended, the OK button is intermittently lighted up.

13. An apparatus for selecting a product in a vending machine by inputting, through the operation of a plurality of input buttons, a product number composed of a plurality of characters assigned to each product, said apparatus comprising:

a group of product selection buttons, which have the plurality of input buttons respectively on which the plurality of characters are written one letter by one letter, for inputting the product number;

a correction button which is operated in the course of or after the operation of the group of product selection buttons to permit the product number to be re-input by the group of product selection buttons;

an OK button which is operated after the completion of the operation of the group of product selection buttons to establish the selection of a product;

lighting means which can light up the group of product selection buttons, the correction button, and the OK button separately from one another;

a cash inlet port into which a cash is put;

cash detection means for detecting whether or not a cash has been put into the cash inlet port; and control means for controlling the lighting means in such a manner that, when the cash detection means has detected that the cash has been put into the cash inlet port, the group of product selection buttons and the correction button are lighted up and, after the operation of the group of product selection buttons is ended, the OK button is intermittently lighted up.

* * * * *